United States Patent [19]

Kates et al.

[11] Patent Number: 4,652,178

[45] Date of Patent: Mar. 24, 1987

[54] MINE ROOF PLATE

[75] Inventors: Richard Kates, Oldwick; Mario Chyb, Piscataway, both of N.J.

[73] Assignee: Ingersoll-Rand Company, Woodcliff Lake, N.J.

[21] Appl. No.: 890,977

[22] Filed: Jul. 30, 1986

Related U.S. Application Data

[63] Continuation of Ser. No. 752,991, Jul. 8, 1985, abandoned.

[51] Int. Cl.[4] ..... E21D 21/00

[52] U.S. Cl. ..... 405/259; 411/531

[58] Field of Search ..... 405/259–262, 405/288; 411/531, 538; D8/399

[56] References Cited

U.S. PATENT DOCUMENTS

| | | | |
|---|---|---|---|
| D. 275,452 | 9/1984 | Payne | D8/399 |
| 3,238,731 | 3/1966 | Seifert et al. | 405/259 |
| 3,244,055 | 4/1966 | Schuermann et al. | 405/259 X |
| 4,126,004 | 11/1978 | Lindeboom | 405/259 |
| 4,371,293 | 2/1983 | Wilcox et al. | 405/259 |
| 4,445,808 | 5/1984 | Arya | 405/259 |
| 4,518,282 | 5/1985 | Wilcox et al. | 405/259 |

*Primary Examiner*—Richard J. Scanlan, Jr.
*Assistant Examiner*—Nancy J. Stodola
*Attorney, Agent, or Firm*—Bernard J. Murphy

[57] ABSTRACT

The plate has the plate material in-turned, about the central, roof bolt or friction rock stabilizer aperture, to form a tubular wall thereat. Accordingly, the rim of the aperture is made stronger and the plate, therefore, is capable of supporting a considerable loading.

5 Claims, 2 Drawing Figures

MINE ROOF PLATE

This is a continuation of application Ser. No. 752,991 filed on July 8, 1985, now abandoned.

This invention pertains to mine roof plates, and in particular to an improved roof plate, of considerable load-carrying capacity, for use where prior art roof plates are inadequate.

Mine roof plates are used in mines, tunnels, rock cuts, and other excavations, with roof bolts or friction rock stabilizers to bind together rock strata. This is to stabilize the rock formation and inhibit its collapse.

Exemplary of mine roof plates useful with friction rock stabilizers is that disclosed in U.S. Pat. No. 4,445,808, issued May 1, 1984, to Satya P. Arya, for a "Mine Roof Plate". The patented mine roof plate has a central aperture, in which to receive a friction rock stabilizer, of 1.39-inch (35.30 mm.) or 1.60-inch (40.64 mm.) diameter. Too, the aperture has a rim defined by a straight, cantilevered edge.

It is an object of this invention to disclose a mine roof plate in which the rim of the aperture is greatly strengthened.

It is particularly an object of this invention to set forth a mine roof plate comprising a plate formed of rigid, sheet material; said plate having a first, outer, peripheral portion, and a second, inner, substantially central portion; wherein said first portion has a substantially uniplanar, earth-engaging surface; and said second portion is disposed at an angle relative to said surface;

said second portion has an aperture formed therein, and comprises a tubular wall (a) bounding said aperture, and (b) circumscribing an axis which extends normal to said surface, and subsists centrally in said aperture.

Figure 1:
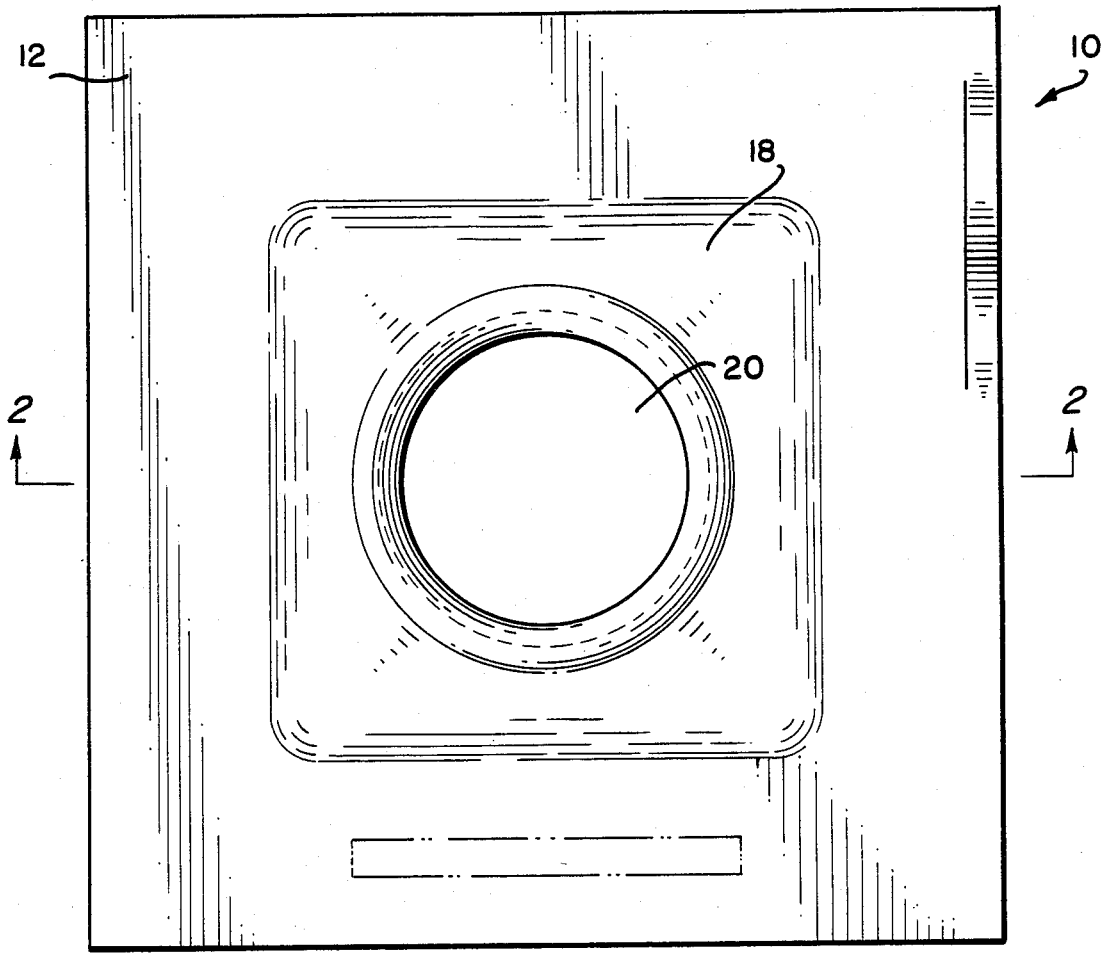
Figure 2:
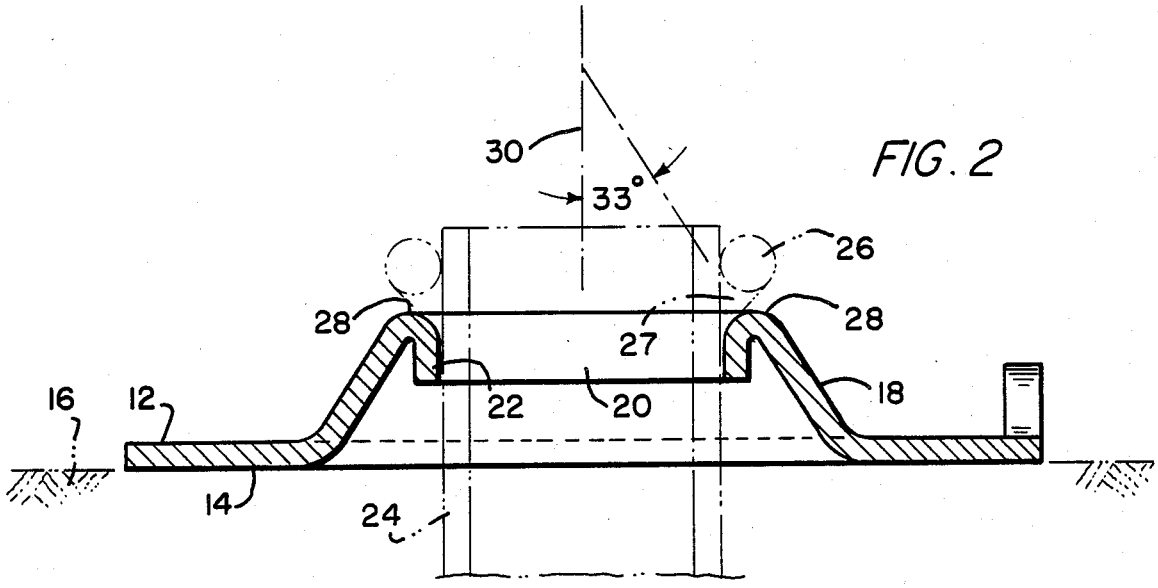

Further objects of this invention, as well as the novel features thereof, will become more apparent by reference to the following description, taken in conjunction with the accompanying figures, in which:

FIG. 1 is a plan view of the bottom surface of the novel mine roof plate according to an embodiment thereof; and FIG. 2 is a cross-sectional view taken along section 2—2 of FIG. 1.

As shown in the figures, the new mine roof plate 10, according to an embodiment thereof, is formed of rigid, sheet steel. The plate 10 is four-sided, and has a first, outer peripheral portion 12 which has an earth-engaging surface 14 disposed in a plane 16. The plate 10 has a second, inner, substantially central portion 18 which has an aperture 20 formed therein. Portion 18 is formed as a dome extending (in this view: rising) from the relatively elevated portion 12.

The aperture 20 is defined and bounded by a tubular wall 22 formed by an in-turned portion of the sheet steel. In FIG. 2 a phantomed depiction of a portion of a friction rock stabilizer 24 is shown, together with its annular, wire-rod reinforcement 26. The reinforcement 26 is welded to the stabilizer; the welded bead is also phantomed in FIG. 2 and designated with the index number 27. As is understood by those skilled in this art, the reinforcement 26 comes to bear against the rim 28 of the aperture 20, indirectly, through the welded bead 27. The latter closes directly onto the rim 28. The rim 28 defines an annular bearing surface which, due to the tubular wall 22 thereabove, is greatly strengthened. The in-turned portion of the steel, which forms the tubular wall 22, is parallel, or concentric, with the center axis 30 and forms an acute angle of approximately thirty-three degrees of arc with portion 18. While we have described our invention in connection with a specific embodiment thereof, it is to be clearly understood that this is done only by way of example and not as a limitation to the scope of our invention as set forth in the objects thereof and in the appended claims.

We claim:

1. A mine roof plate, for a friction rock stabilizer, comprising:

a plate formed of rigid, sheet material;

said plate having a first, outer peripheral portion, and a second, inner substantially central portion; wherein said first portion has a substantially uniplanar, earth-engaging surface;

said second portion is disposed at an angle relative to said surface;

said second portion has an aperture formed therein, and comprises a tubular wall, having, a single inside diameter, (a) bounding said aperture, and (b) circumscribing an axis which extends normal to said surface, and subsists centrally in said aperture;

said tubular wall is formed of an in-turned portion of said material;

said in-turned portion comprises an annular bearing surface for the friction rock stabilizer at one end of said wall;

said plate has an overall, total depth; and said annular bearing surface, and said earth-engaging surface subsist on outermost opposite sides of said plate and, therefore and therebetween, define said overall total depth of said plate.

2. A mine roof plate, according to claim 1, wherein:

said wall, and said second central portion, form an acute angle therebetween of approximately thirty-three degrees of arc.

3. A mine roof plate, according to claim 1, wherein:

said central portion comprises a generally tapered dome; and said aperture is formed within said dome.

4. A mine roof plate, according to claim 3, wherein:

said tubular wall is confined within said dome.

5. A mine roof plate, according to claim 3, wherein:

said tubular wall extends into said dome.

* * * * *